United States Patent [19]

Jones

[11] Patent Number: 4,890,207

[45] Date of Patent: Dec. 26, 1989

[54] REMOTE CONTROLLED SPOTLIGHT SYSTEM

[75] Inventor: Danny C. Jones, Clifton, Tex.

[73] Assignee: Star Beam, Inc., Clifton, Tex.

[21] Appl. No.: 245,033

[22] Filed: Sep. 12, 1988

[51] Int. Cl.[4] ..... F21S 1/00

[52] U.S. Cl. ..... 362/233; 362/419; 362/286; 362/272; 362/258

[58] Field of Search ..... 362/418, 419, 386, 387, 362/285, 128.6, 287, 272, 275, 277, 427, 428, 258, 371, 233, 382, 804; 318/16, 625

[56] References Cited

U.S. PATENT DOCUMENTS

| | | | |
|---|---|---|---|
| 412,713 | 10/1889 | Sayers et al. | 191/12.2 R |
| 1,216,422 | 2/1917 | Dunham | 362/387 |
| 1,319,247 | 10/1919 | Ronig | 248/324 |
| 2,911,519 | 11/1957 | Phillips et al. | 362/272 |
| 3,319,061 | 5/1967 | Pohl et al. | 362/258 |
| 3,842,386 | 10/1974 | Suska | 439/31 |
| 3,936,670 | 2/1976 | Allen, Sr. | 362/258 |
| 4,167,783 | 9/1979 | Mitchell | 362/285 |
| 4,598,345 | 7/1986 | Kleeman | 362/286 |
| 4,626,973 | 12/1986 | Ulmann et al. | 362/419 |
| 4,712,167 | 12/1987 | Gerdin et al. | 562/85 |
| 4,814,955 | 3/1989 | Price | 362/419 |

*Primary Examiner*—Ira S. Lazarus
*Assistant Examiner*—D. M. Cox
*Attorney, Agent, or Firm*—H. Dennis Kelly

[57] ABSTRACT

A remote controlled spotlight system having a pair of spotlights on the ends of a horizontal shaft extending through a housing. A vertical shaft extends out of the housing for mounting purposes. An electric motor in the housing rotates the horizontal shaft about its longitudinal axis to aim the spotlights up or down. A second electric motor in the housing rotates the housing about the longitudinal axis of the vertical shaft to aim the spotlights left or right. The electrical motors are remotely controlled. An electrical power cord extends through the bore of the horizontal shaft, out through a hole in the horizontal shaft, and winds around the horizontal shaft at least twice. The cord then winds around the vertical shaft at least twice, and then passes through the bore of the vertical shaft to a power source.

15 Claims, 5 Drawing Sheets

REMOTE CONTROLLED SPOTLIGHT SYSTEM

BACKGROUND OF THE INVENTION

1. Field of the Invention

This invention relates in general to electric lighting systems. In particular, the invention relates to remote controlled spotlight systems.

2. Description of the Prior Art

When construction or utility workers are working at night, the necessary lighting is sometimes supplied by an electric lighting system mounted on a truck. The lighting system must be capable of supplying sufficient light, using an available power source. The system must also be rugged and durable to withstand typical construction environments.

Some prior art lighting systems must be manually aimed. If the lights are accidentally jarred, or if the worker moves to a new area, the worker must return to the lighting system to make proper adjustments. It is preferable for the lighting system to be remotely controlled, so that the worker can adjust the direction of the light without having to return to the system.

Many prior art lighting systems are rotatable in both horizontal and vertical planes. However, most of these systems have electric brush connections, so the systems are not sufficiently rugged and durable. Brush connections tend to corrode and prematurely fail. Brush connections can also create radio interference that can interfere with other equipment.

SUMMARY OF THE INVENTION

The remote controlled spotlight system of the invention has a horizontal shaft and a vertical shaft extending out of a housing. The vertical shaft extends downward out of the housing, so that the housing can be mounted, such as on a truck. A pair of spotlights are attached to the ends of the horizontal shaft. An electric motor, within the housing, rotates the horizontal shaft about its longitudinal axis to aim the spotlight up or down. A second electric motor, also in the housing, rotates the housing about the longitudinal axis of the vertical shaft to aim the spotlights left or right. The electric motors are controlled by a wireless remote controller.

An electrical power cord supplies electrical power to the spotlights. The power cord extends from the spotlights through the bore of the horizontal shaft. The power cord exits through a hole in the horizontal shaft, and winds around the horizontal shaft at least twice. The power cord then winds around the vertical shaft at least twice, and enters a hole in the vertical shaft. The power cord passes through the bore of the vertical shaft to a power source, such as a battery.

DESCRIPTION OF THE PREFERRED EMBODIMENT

Figure 1:
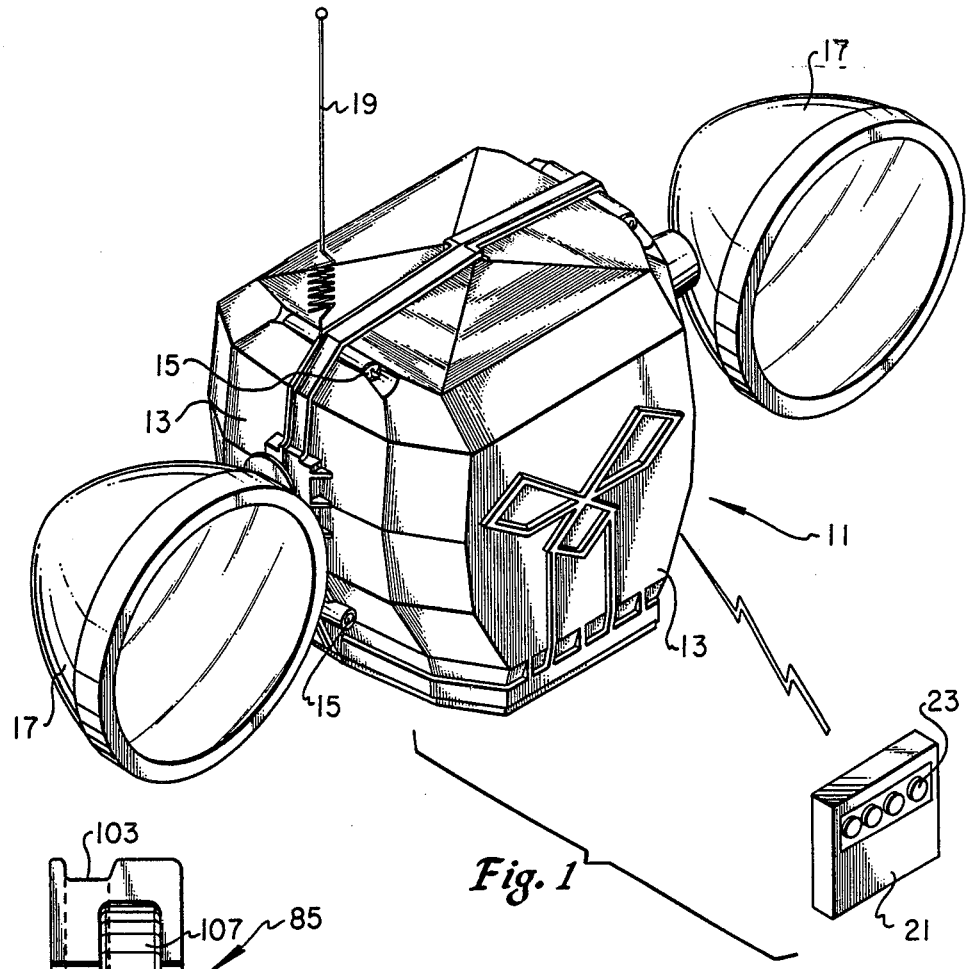
FIG. 1 is a perspective drawing of the spotlight system of the invention.
Figure 6:
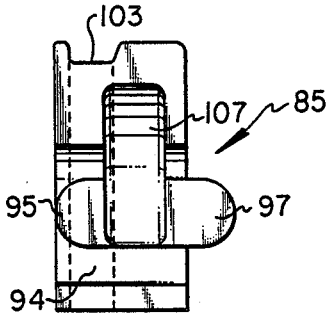
FIG. 6 is a bottom view of the wire winder of the invention.
Figure 7:
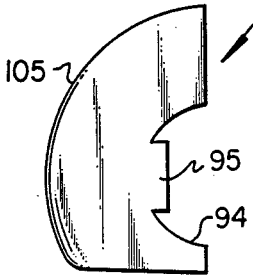
FIG. 7 is a left side view of the wire winder of the invention.
Figure 8:
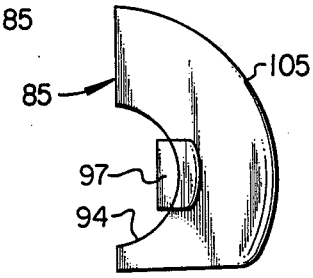
FIG. 8 is a right side view of the wire winder of the invention.
Figure 9:
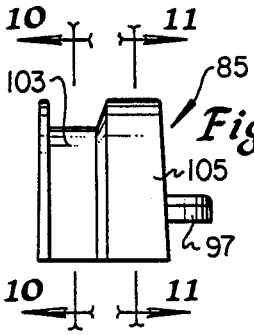
FIG. 9 is a front view of the wire winder of the invention.
Figure 10:
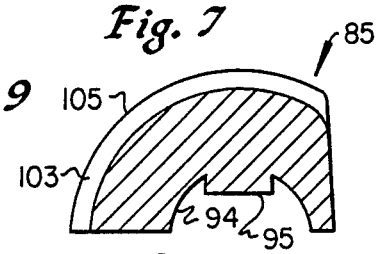
FIG. 10 is a sectional view of the wire winder of the invention, as seen along lines 10—10 in FIG. 9.
Figure 11:
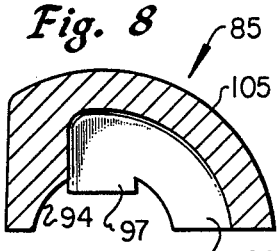
FIG. 11 is a sectional view of the wire winder of the invention, as seen along lines 11—11 in FIG. 9.

As shown in FIG. 1, the spotlight system of the invention has a housing 11 that includes two identical and mating covers 13. The covers 13 are made of a lightweight and durable plastic, and are held together by fasteners, such as screws 15.

A pair of spotlights 17 are mounted on opposite sides of the housing 11. The exact type of spotlight 17 used depends upon the particular purpose of the spotlight system.

A receiving antenna 19 on top of the housing 11 receives signals from a controller 21. The controller 21 is a common wireless remote controller of a type well known in the prior art. The controller 21 may have buttons 23 for aiming the spotlights 17 up, down, left, or right.

Figure 2:
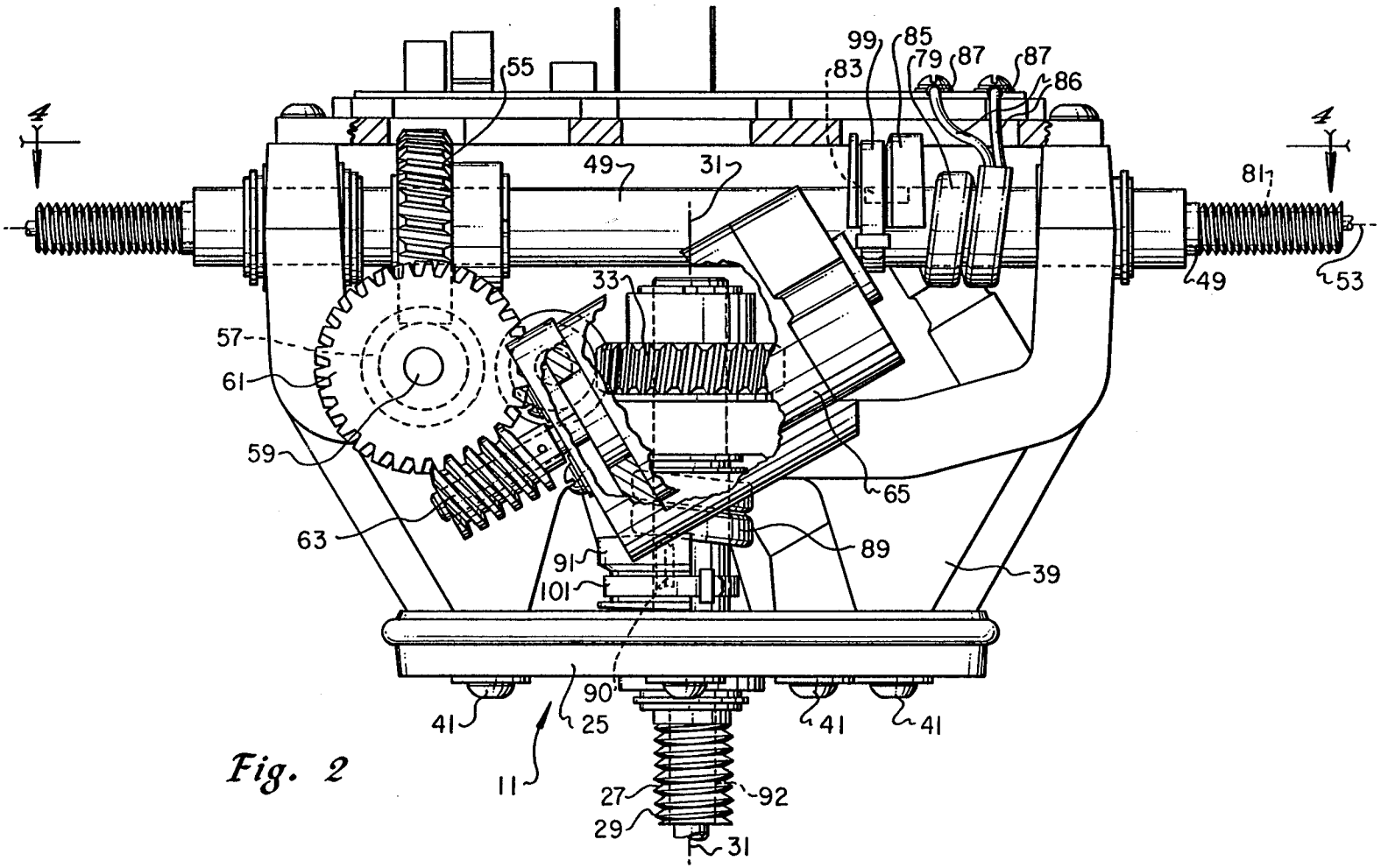
FIG. 2 is a plan view of the spotlight system of the invention, with the covers removed and some of the parts partially broken away.
Figure 3:
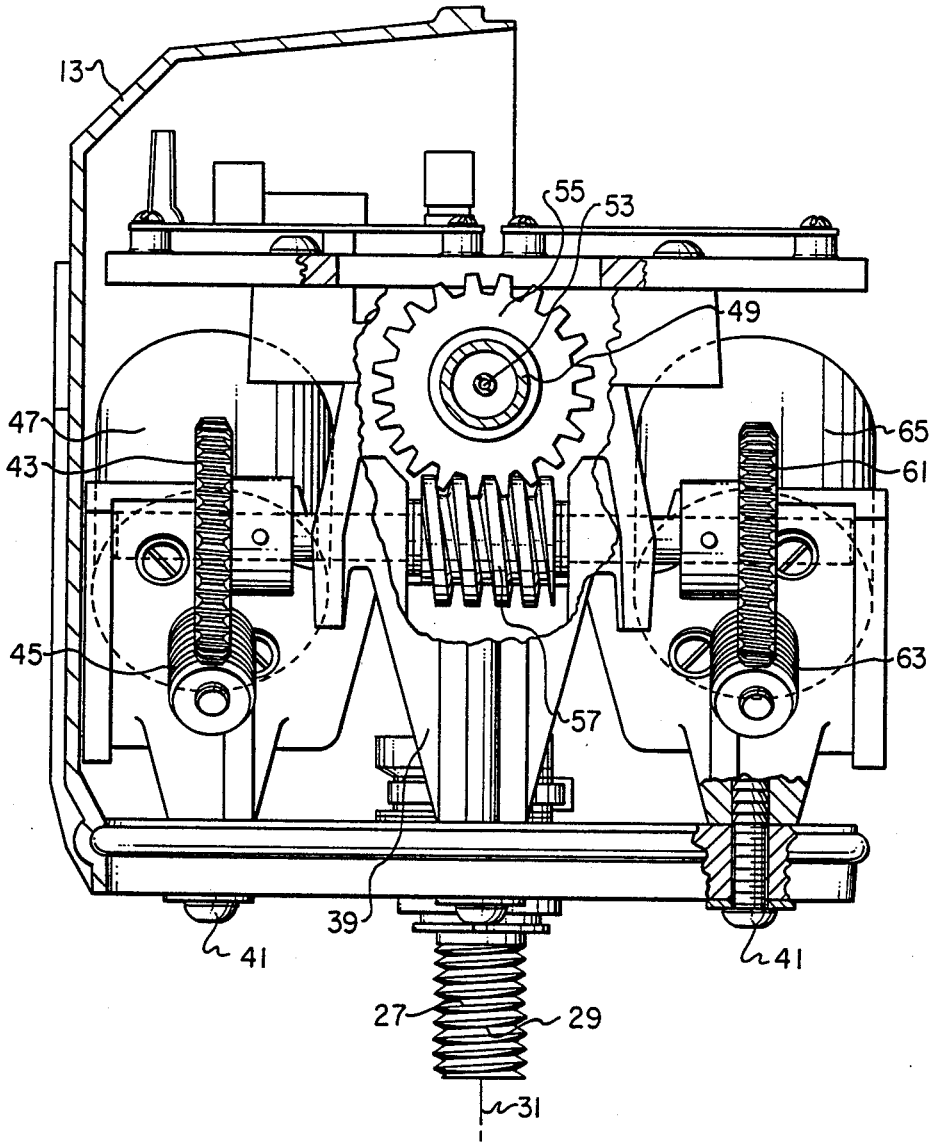
FIG. 3 is a side view of the spotlight system of the invention, with one of the covers removed and with some of the parts partially broken away.

As shown in FIGS. 2 and 3, the housing 11 also includes a base plate 25. A vertical shaft 27 extends downward through the base plate 25 of the housing 11. The lower end of the vertical shaft 27 has threads 29 so that the housing 11 can be mounted on a support, such as a truck.

Figure 4:
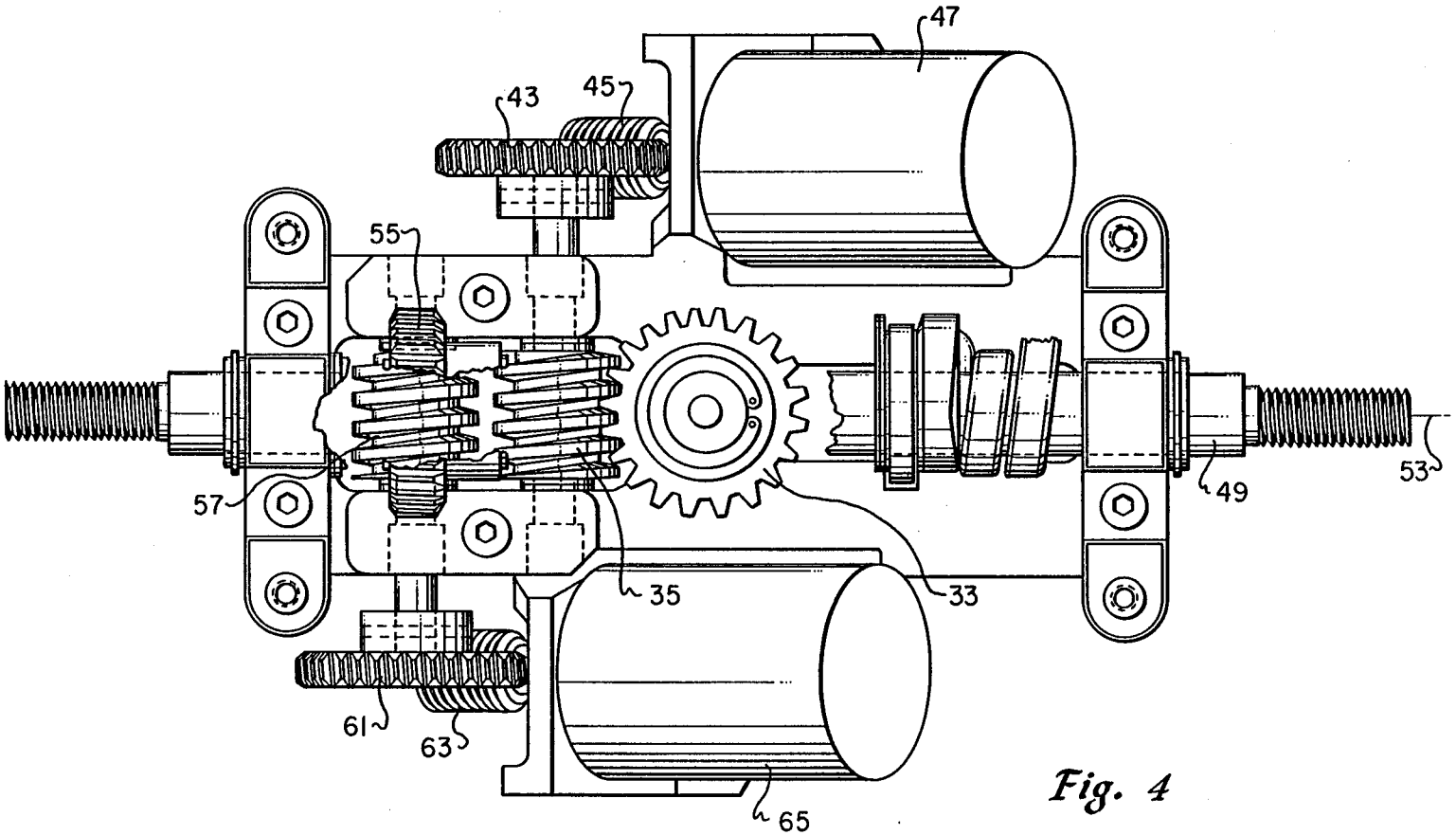
FIG. 4 is a top view of the spotlight system of the invention, with the covers and the electrical circuit plates removed and some of the parts partially broken away.

The housing 11 is rotatable about the longitudinal axis 31 of the vertical shaft 27 to aim the spotlights 17 left or right. A stationary horizontal gear 33, located on the upper end of the vertical shaft 27, is engaged by a primary worm gear 35 on a primary shaft 37, as shown in FIG. 4. The primary shaft 37 is supported by a plastic frame 39 that is attached to the base plate 25 by a plurality of fasteners, such as screws 41.

A vertical gear 43 on the end of the primary shaft 37 engages a motor worm gear 45 on the output shaft of an electric motor 47. The electric motor 47 is supported by the plastic frame 39. When the electric motor 47 is activated, the motor worm gear 45 drives the vertical gear 43 to rotate the primary shaft 37 and the primary worm gear 35. The primary worm gear 35 engages the horizontal gear 33 to rotate the housing 11 about the longitudinal axis 31 of the vertical shaft 27.

The two spotlights 17, shown in FIG. 1, are fastened to the ends of a horizontal shaft 49. The horizontal shaft 49 has standard threads 51 on each end, so that many different types of spotlights 17 can be used. The horizontal shaft 49 extends through the housing 11 and is supported by the plastic frame 39.

The horizontal shaft 49 and the spotlights 17 can be rotated about the longitudinal axis 53 of the horizontal shaft 49 to aim the spotlights 17 up or down. A vertical gear 55 on the horizontal shaft 49 is engaged by a primary worm gear 57 on a primary shaft 59. A vertical gear 61 on the end of the primary shaft 59 engages a motor worm gear 63 on the output shaft of a second electric motor 65. The second electric motor 65 is supported by the plastic frame 39. When the electric motor 65 is activated, the horizontal shaft 49 and the spotlights 17 are rotated about the longitudinal axis 53 of the horizontal shaft 49 to aim the spotlights 17 up or down. The electric motor 65 rotates the motor worm gear 63. The worm gear 63 drives the vertical gear 61 to rotate the primary shaft 59 and the primary worm gear 57. The primary worm gear 57 engages the vertical gear 55 on the horizontal shaft 49 to rotate horizontal shaft 49 about its longitudinal axis 53.

Figure 5:
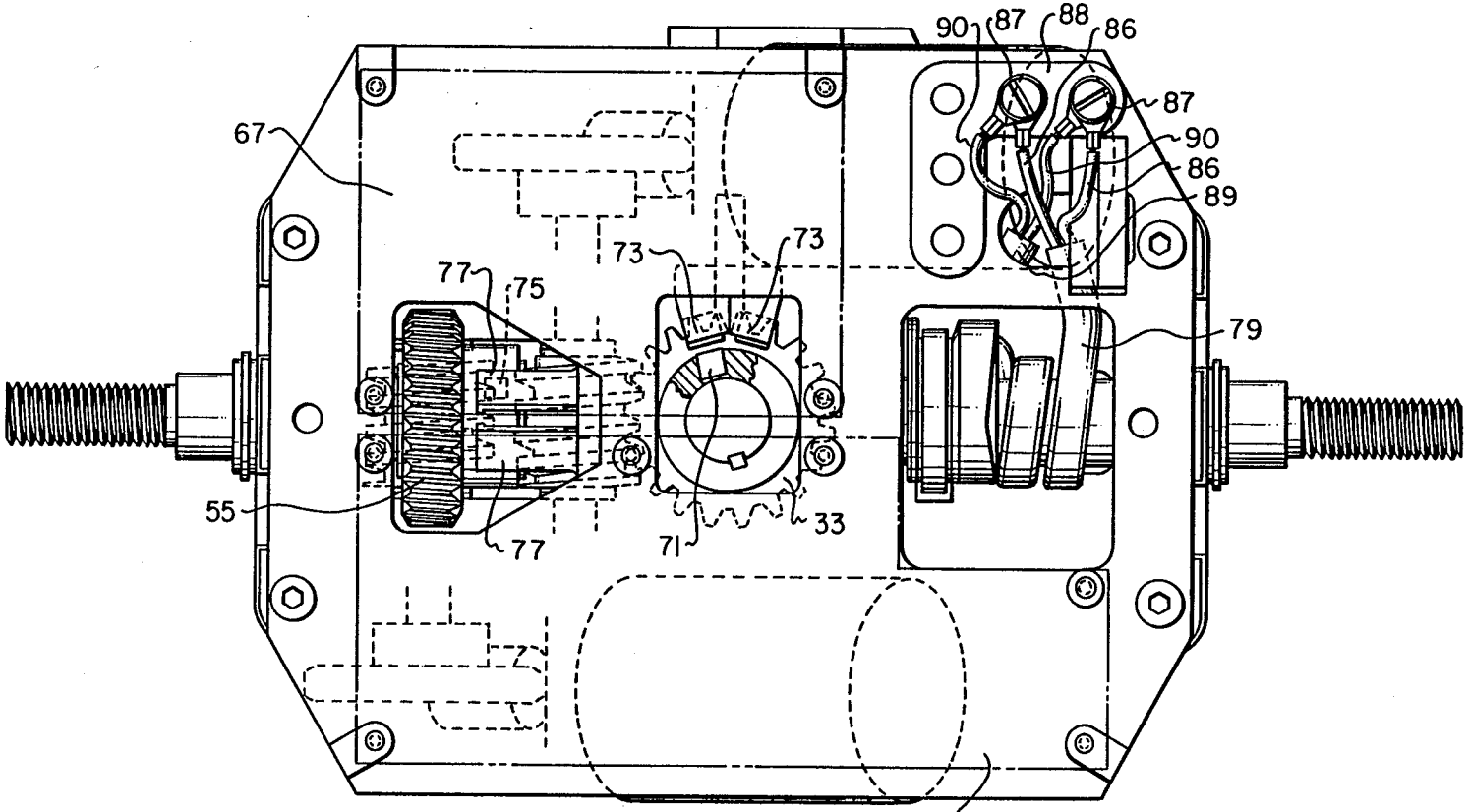
FIG. 5 is a top view of the spotlight system of the invention, with the covers removed.

The two electric motors 47 and 65 are controlled by a pair of printed circuit boards, shown in FIG. 5. The antenna 19 is electrically connected to a wireless remote receiver board 67. The receiver board 67 processes the signal from the antenna 19 and passes it to a motor driver board 69. The motor driver board 69 then causes the correct electric motor 47 or 65 to activate in the proper direction to rotate the housing 11 left or right or to rotate the spotlights 17 up or down.

The preferred embodiment of the invention limits rotation to 330 degrees on both axes 31 and 53. The means for limiting the rotation is illustrated in FIG. 5. Rotation about the longitudinal axis 31 of the vertical shaft 27 is limited by means of a magnet 71 imbedded in the vertical shaft 27. A pair of hall effect switches 73 rotate around the vertical shaft 27 as the housing 11 rotates. The hall effect switches 73 sense the relative location of the magnet 71 and shut off the electric motor 47 to prevent rotation of the housing 11 beyond 350 degrees.

Similarly, a magnet 75 imbedded in the horizontal shaft 49 rotates with the horizontal shaft 49. A second pair of hall effect switches 77 are fixed on the plastic frame 39 near the magnet 75. As the horizontal shaft 49 and the magnet 75 rotate, the hall effect switches 77 sense the relative location of the magnet 75. The hall effect switches 77 shut off the electric motor 65 to prevent rotation of the horizontal shaft 49 beyond 350 degrees.

As shown in FIG. 2, an electrical power cord 79 supplies electrical power to the spotlights 17. The power cord 79 extends from each spotlight 17 through the bore 81 of the horizontal shaft 49. The cord 79 exits the horizontal shaft 49 through a hole 83, and winds around the horizontal shaft 49 at least twice. A wire winder 85 on the horizontal shaft 49 insures that the power cord 79 is properly wound and unwound about the horizontal shaft 49 as the shaft 49 rotates. Each coil of the power cord 79 takes some of the slack as the cord 79 is unwound from the shaft 49. Therefore, several revolutions around the shaft 49 require less vertical space for the cord 79 to unwind than a single revolution would.

The power cord 79, and the two electrical wires 86 within the cord 79, terminate at a pair of connectors 87 on a termination block 88, as shown in FIG. 5. A second power cord 89 has a pair of electrical wires 90 that are also connected to the connectors 87 on the termination block 88. The second power cord 89 is thus an extension of the first power cord 79.

The second power cord 89 then winds around the vertical shaft 27 at least twice, and enters a hole 90 in the vertical shaft 27. A wire winder 91 facilitates the winding and unwinding of the power cord 89 about the vertical shaft 27. The power cord 89 passes through the bore 92 of the vertical shaft 27 to a power source, such as a battery.

FIGS. 6–11 illustrate the wire winder 85 on the horizontal shaft 49 in greater detail. The wire winder 91 on the vertical shaft 27 is identical.

The wire winder 85 has a semicircular inner surface 93 that engages the outer surface of the horizontal shaft 49. A pair of semicircular keys 95 and 97 on the wire winder 85 fit within the hole 83 in the horizontal shaft 49 to properly orient the wire winder 85.

The wire winders 85 and 91 are secured to the horizontal shaft 49 and the vertical shaft 27, respectively, by tie wraps 99 and 101, as shown in FIG. 2. A groove 103 in the outer surface 105 of the wire winder 84 holds the tie wrap 99 in place. A curved slot 107 in the inner surface 93 of the wire winder 85 guides the electric power cord 79 out of the hole 83 and one quarter of a revolution around the horizontal shaft 49.

The remote controlled spotlight system of the invention has several advantages over the prior art. The spotlight system of the invention is light weight and portable. The systems allows rotation about two axes, without electrical brush connections that can cause radio interference. Further, the spotlight system of the invention is durable and sturdy. The closed housing 11 of the system and the lack of electrical brush connections enables the system to be used in extremely adverse environments without corroding or failing prematurely.

The invention has been shown in only the preferred embodiment. It should be understood that various modifications, changes, and substitutions may be made without departing from the scope of the invention.

I claim:

1. A remote controlled spotlight system, comprising:

a horizontal shaft having a longitudinal axis and a bore;

a light mounted on the horizontal shaft;

means for rotating the horizontal shaft about the longitudinal axis of the horizontal shaft;

a vertical shaft having a longitudinal axis and a bore;

means for rotating the horizontal shaft about the longitudinal axis of the vertical shaft;

control means for remotely controlling the means for rotating the horizontal shaft about the longitudinal axis of the horizontal shaft and the means for rotating the horizontal shaft about the longitudinal axis of the vertical shaft; and an electrical power cord extending from the light through the bore of the horizontal shaft, out through a hole in the horizontal shaft, at least once around the horizontal shaft, at least once around the vertical shaft, and then into the bore of the vertical shaft.

2. The remote controlled spotlight system as recited in claim 1, wherein the power cord extends at least twice around the horizontal shaft.

3. The remote controlled spotlight system as recited in claim 1, wherein the power cord extends at least twice around the vertical shaft.

4. The remote controlled spotlight system as recited in claim 2, wherein the power cord extends at least twice around the vertical shaft.

5. A remote controlled spotlight system, comprising:

a horizontal shaft having a longitudinal axis and a bore;

a light mounted on the horizontal shaft;

means for rotating the horizontal shaft about the longitudinal axis of the horizontal shaft;

a vertical shaft having a longitudinal axis and a bore;

means for rotating the horizontal shaft about the longitudinal axis of the vertical shaft;

control means for remotely controlling the means for rotating the horizontal shaft about the longitudinal axis of the horizontal shaft and the means for rotating the horizontal shaft about the longitudinal axis of the vertical shaft;

an electrical power cord extending from the light through the bore of the horizontal shaft, out through a hole in the horizontal shaft, at least once around the horizontal shaft, at least once around the vertical shaft, and then into the bore of the vertical shaft; and a wire winder mounted on the horizontal shaft for guiding the power cord.

6. The remote controlled spotlight system as recited in claim 5, wherein the wire winder has a curved slot that guides the power cord out of the hole in the horizontal shaft and at least one quarter of a revolution around the horizontal shaft.

7. A remote controlled spotlight system, comprising:

a housing;

a horizontal shaft, having a longitudinal axis and a bore, mounted in the housing so that each end of the horizontal shaft extends out of the housing;

a pair of spotlights mounted on the ends of the horizontal shaft;

a first electric motor, mounted in the housing for rotating the horizontal shaft about the longitudinal axis of the horizontal shaft;

a vertical shaft having a longitudinal axis and a bore, and extending out of the housing;

a second electric motor, mounted in the housing, for rotating the housing about the longitudinal axis of the vertical shaft;

a remote controller for remotely controlling the first and second electric motors; and an electrical power cord extending from the spotlights through the bore of the horizontal shaft, out through a hole in the horizontal shaft, at least once around the horizontal shaft, at least once around the vertical shaft, and then into the bore of the vertical shaft.

8. The remote controlled spotlight system as recited in claim 7, wherein the power cord extends at least twice around the horizontal shaft.

9. The remote controlled spotlight system as recited in claim 7, wherein the power cord extends at least twice around the vertical shaft.

10. The remote controlled spotlight system as recited in claim 8, wherein the power cord extends at least twice around the vertical shaft.

11. A remote controlled spotlight system, comprising:

a housing;

a horizontal shaft, having a longitudinal axis and a bore, mounted in the housing so that each end of the horizontal shaft extends out of the housing;

a pair of spotlights mounted on the ends of the horizontal shaft;

a first electric motor, mounted in the housing for rotating the horizontal shaft about the longitudinal axis of the horizontal shaft;

a vertical shaft having a longitudinal axis and a bore, and extending out of the housing;

a second electric motor, mounted in the housing, for rotating the housing about the longitudinal axis of the vertical shaft;

control means for remotely controlling the first and second electric motors;

an electric power cord extending from the spotlights through the bore of the horizontal shaft, out through a hole in the horizontal shaft, at least once around the horizontal shaft, at least once around the vertical shaft, and then into the bore of the vertical shaft; and a wire winder mounted on the horizontal shaft for guiding the power cord.

12. The remote controlled spotlight system as recited in claim 11, wherein the wire winder has a curved slot that guides the power cord out of the hole in the horizontal shaft and at least one quarter of a revolution around the horizontal shaft.

13. A remote controlled spotlight system, comprising:

a first shaft having a longitudinal axis and a bore;

a light mounted on the first shaft;

a first electric motor for rotating the first shaft about the longitudinal axis of the first shaft;

a second shaft having a bore and a longitudinal axis perpendicular to the longitudinal axis of the first shaft;

a second electric motor for rotating the first shaft about the longitudinal axis of the second shaft;

a remote controller for remotely controlling the first and second electric motors;

an electric power cord extending from the light through the bore of the first shaft, out through a hole in the first shaft, at least once around the first shaft, at least once around the second shaft, and then into the bore of the second shaft; and a wire winder mounted on the first shaft for guiding the power cord.

14. A remote controlled spotlight system, comprising:

a first shaft having a longitudinal axis and a bore;

a light mounted on the first shaft;

a first electric motor for rotating the first shaft about the longitudinal axis of the first shaft;

a second shaft having a bore and longitudinal axis perpendicular to the longitudinal axis of the first shaft;

a second electric motor for rotating the first shaft about the longitudinal axis of the second shaft;

a remote controller for remotely controlling the first and second electric motors;

an electric power cord extending from the light through the bore of the first shaft, out through a hole in the first shaft, at least once around the first shaft, at least once around the second shaft, and then into the bore of the second shaft;

a magnet imbedded in the first shaft; and a pair of hall effect switches for sensing the location of the magnet and for shutting off the first electric motor to limit the rotation of the first shaft about the longitudinal axis of the first shaft.

15. A remote controlled spotlight system as recited in claim 14, further comprising:

a magnet imbedded in the second shaft; and a pair of hall effect switches for sensing the location of the magnet in the second shaft and for shutting off the second electric motor to limit the rotation of the first shaft about the longitudinal axis of the second shaft.

* * * * *